US007360261B1

(12) United States Patent
Sheliga

(10) Patent No.: US 7,360,261 B1
(45) Date of Patent: Apr. 22, 2008

(54) SOFA

(75) Inventor: Donald Sheliga, South Bend, IN (US)

(73) Assignee: Progressive Design Solutions, LLC, Osceola, IN (US)

( * ) Notice: Subject to any disclaimer, the term of this patent is extended or adjusted under 35 U.S.C. 154(b) by 126 days.

(21) Appl. No.: 11/427,791

(22) Filed: Jun. 30, 2006

(51) Int. Cl.
*A47C 17/16* (2006.01)
*A47C 19/20* (2006.01)

(52) U.S. Cl. ..... 5/12.1; 5/28; 5/58; 5/9.1

(58) Field of Classification Search ..... 5/9.1, 5/12.1, 28, 53.2, 58; 297/62, 112
See application file for complete search history.

(56) References Cited

U.S. PATENT DOCUMENTS 591,095 A * 10/1897 Evans ..... 297/62
2,891,255 A * 6/1959 Simmons ..... 5/9.1
3,191,194 A * 6/1965 Griffin ..... 5/9.1
3,316,563 A * 5/1967 Vogel ..... 5/9.1
3,594,832 A * 7/1971 Bryks ..... 5/9.1
3,736,601 A * 6/1973 Riches ..... 5/9.1
4,051,564 A 10/1977 Gudish
4,555,821 A * 12/1985 Page ..... 5/9.1
4,592,101 A 6/1986 Page

* cited by examiner

*Primary Examiner*—Michael Trettel
(74) *Attorney, Agent, or Firm*—Leo H. McCormick, Jr.

(57) ABSTRACT

A sofa has a first frame fixed to first and second side members and a mattress with a first section secured to the first frame and a second section located over the first section by a hinge to define a seat that is rotated about the hinge to define a first sleeping surface. A second frame is pivotally attached to the first and second side members with a second mattress attached thereto to define a back for the sofa. A rail is secured to the second frame and engages a beam that extends between the first and second side member to set an incline for the back. The rail is rotated to define a barrier when the second frame is positioned a horizontal plane to define a second sleeping surface. Legs that extend from the second frame engage the side members to retain the second mattress in the horizontal plane.

11 Claims, 6 Drawing Sheets

SOFA

This invention relates to a sofa having a seat that may be converted into a first sleeping surface and a back that may be converted into a second sleeping surface.

BACKGROUND OF THE INVENTION

U.S. Pat. Nos. 4,051,564; 4,555,821 and 4,592,101 and are typical illustrations of a sofa that may be converted into a bunk bed by rotating the back of the sofa from an inclined position to a horizontal position. In U.S. Pat. Nos. 4,555,821 and 4,592,101 the incline of the back is determined by the engagement with a tilted storage member that extends from the base to the top of a back member on which the back is hinged with the seat and the back having a substantially equal size to accommodate a single person when the back and seat are positioned in a mode to accommodate a sleeping situation. While these sofas may function in an adequate manner they do require considerable effort in conversion from a sofa to a bunk bed.

SUMMARY OF THE INVENTION

The present invention discloses a sofa wherein as seat may be easily converted into a first sleeping surface that is about twice the size of a back that may be easily converted into a second sleeping surface.

In more particular detail, the sofa includes a first rectangular frame that is fixed to first and second side members. A beam is also fixed to the first and second side member and to the first rectangular frame and together these components form a rigid base for the sofa. A first section of a first mattress has a fixed to the first rectangular frame while a second section thereof is connected to the first section through a hinge and located over the first section defines a seat for the sofa. The first section has a thickness that is of about one third of the second section such that on rotating the second section about the hinge the second section engages the floor of which the sofa is located to define a uniform first horizontal sleeping surface. A second rectangular frame is connected to the first and second side member through first and second pin that extend from a rear side thereof into horizontal bores respectively located in the first and second side members. A second mattress is fixed onto the second rectangular frame to form a cushioned back for the sofa. The second rectangular frame is distinguished by first and second retractable legs that are attached thereto and respectively rotatable and received in horizontally bores in the first and second side members such that the second rectangular frame maybe positioned in a horizontal plane with respect to the first rectangular frame. A third side member that is secured to the second frame and engages the beam when the back is located in a first position to establish an set the incline for the back with respect to the seat may also be rotated when that second rectangular frame is located in the horizontal plane to form a barrier or rail for the second mattress.

An object of the present invention is to provide a compact sofa that may be converted into first and second sleeping surfaces by respectively rotating a second section of a first mattress into a same plane with a first section of the first mattress and by rotating a second mattress about a pivotal connection with first and second side members into a horizontal plane that is parallel with the first mattress to form a bunk that is located above the first sleeping surface.

A further object of this invention is to provide a sofa with a side rail that may be selectively positioned on a frame to set an incline for a back with respect to a seat and to define a barrier on the edge of a sleeping surface.

DETAILED DESCRIPTION OF THE INVENTION

In the specification where similar components are used in more than one situation the component may be identified by a number or a same number plus ' depending on a relationship with other components.

Figure 1:
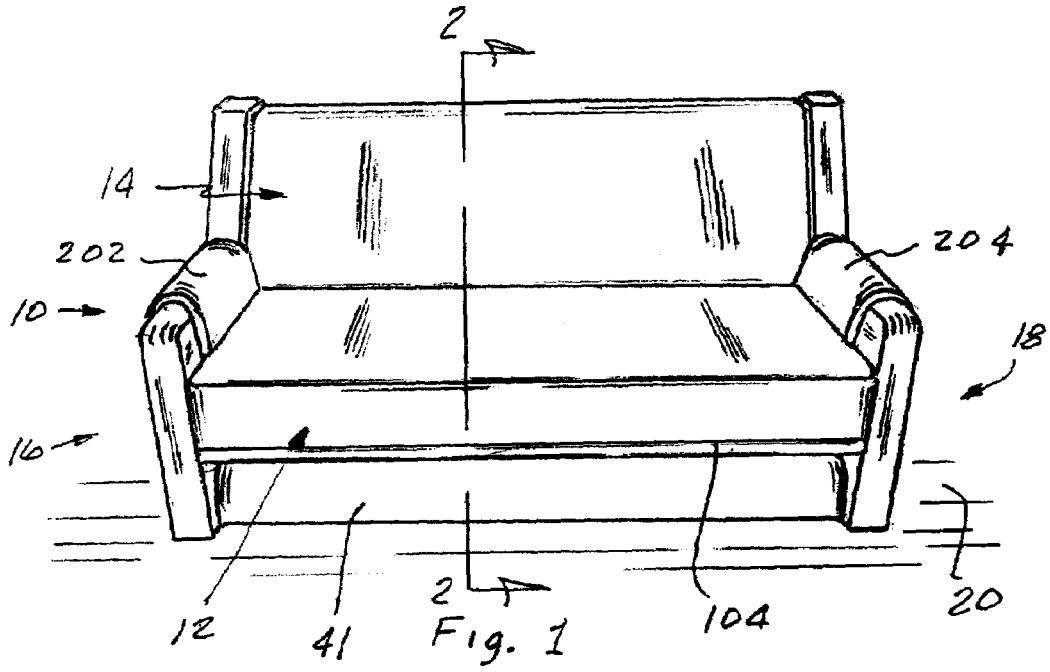
FIG. 1 is schematic illustration of a sofa made according to the present invention.
Figure 2:
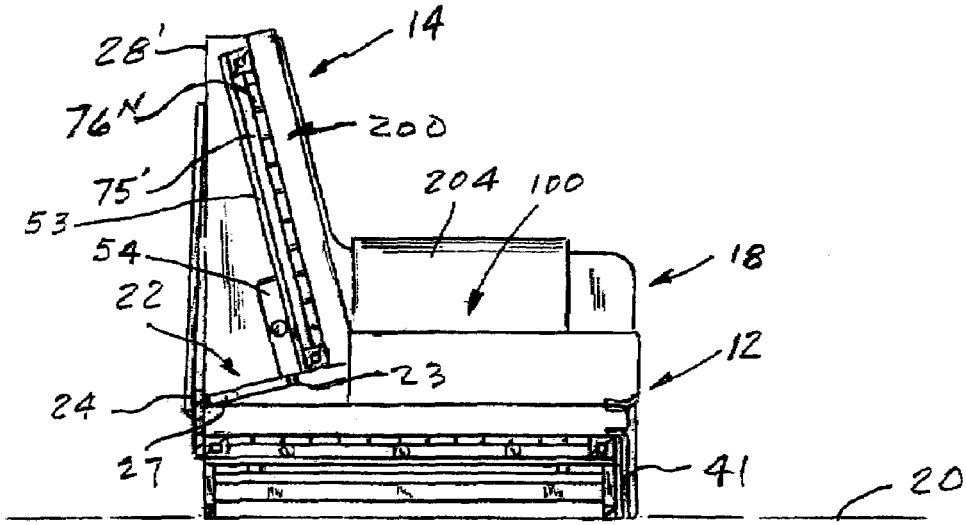
FIG. 2 is a sectional view taken along line 2-2 of FIG. 1.
Figure 3:
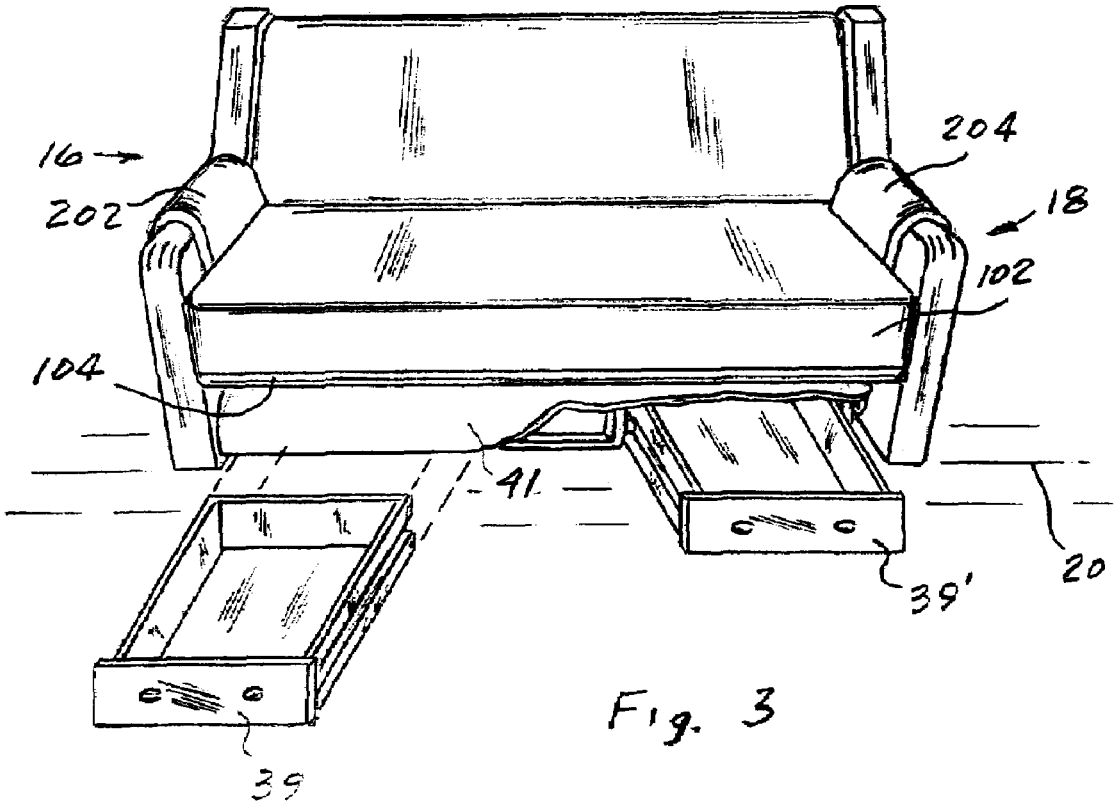
FIG. 3 is a view of the sofa of FIG. 1 showing storage containers positioned under a seat.

The sofa 10 of the present invention is illustrated in FIG. 1 and defined by a seat 12 and a back 14 that are retained between a first side member 16 and a second side member 18. As shown in FIG. 2, the seat 12 is parallel with the floor 20 on which the sofa 10 is located while the back 14 is located on an incline that is determined by the engagement of a side member or rail 22 with a beam 24 that is fixed to a rear face 28 of the first side member 16 and a rear face 28' on the second side member 18. The sofa 10 is designed for installation in a vehicle and to hold the sofa 10 in a stationary location with respect to the floor 20 it is permanently fixed thereto by fasteners 89,89' - - - 89*n*. The side member or rail 22 is resiliently held against the beam 24 by the edge of a first mattress 100 such that a compact unit is produced. In addition, the sofa 10 also has a plurality of storage drawers 39, 39' that are located under the seat 12 and covered by a flap 41 that extends from the first mattress 100, see FIG. 3 to define a compact and unitary component for the vehicle.

Figure 4:
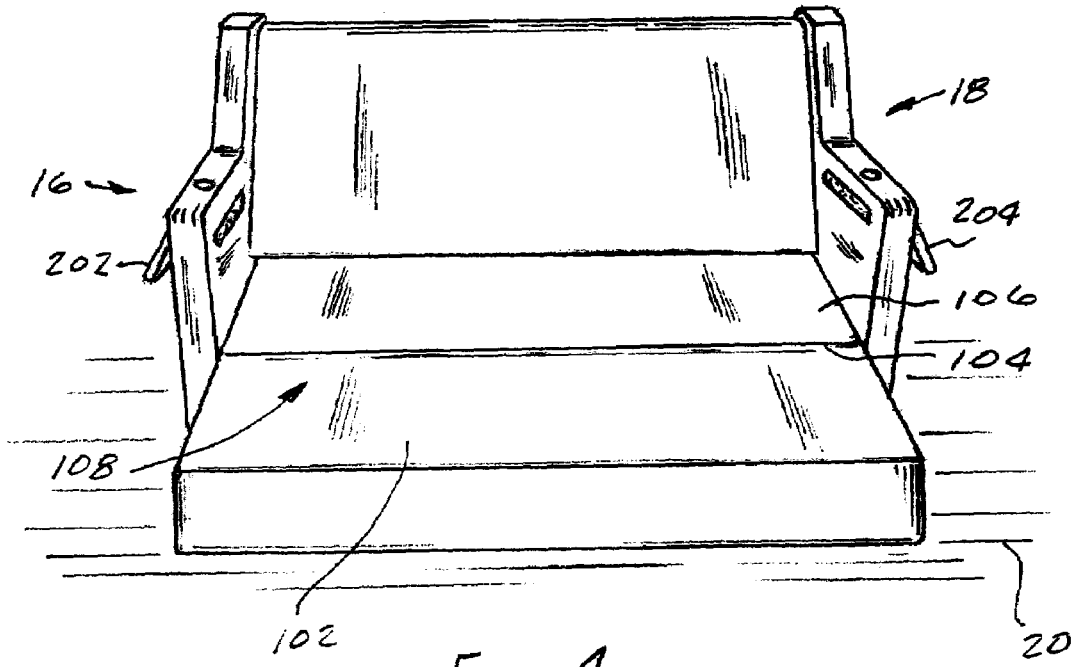
FIG. 4 is a schematic illustration of the sofa of FIG. 1 wherein the seat is converted into a first sleeping surface.

The sofa 10 is primarily designed for sitting but may be converted into a plurality of sleeping surfaces, 108, 208. The first sleeping surface 108 is derived from the seat 12 by rotating a second section 102 of the first mattress 100 that forms the seat 12 about a hinge 104 that is connected to a first section 106 of the seat 12. When the second section 102 engages the floor 20, as illustrated in FIG. 4, a uniform horizontal first sleeping surface 108 is created. The size of the first sleeping surface 108 is such that first individual may comfortably sleep on the first section 106 and a second person may comfortably sleep on the second section 102 without being located over the hinge 104.

Figure 5:
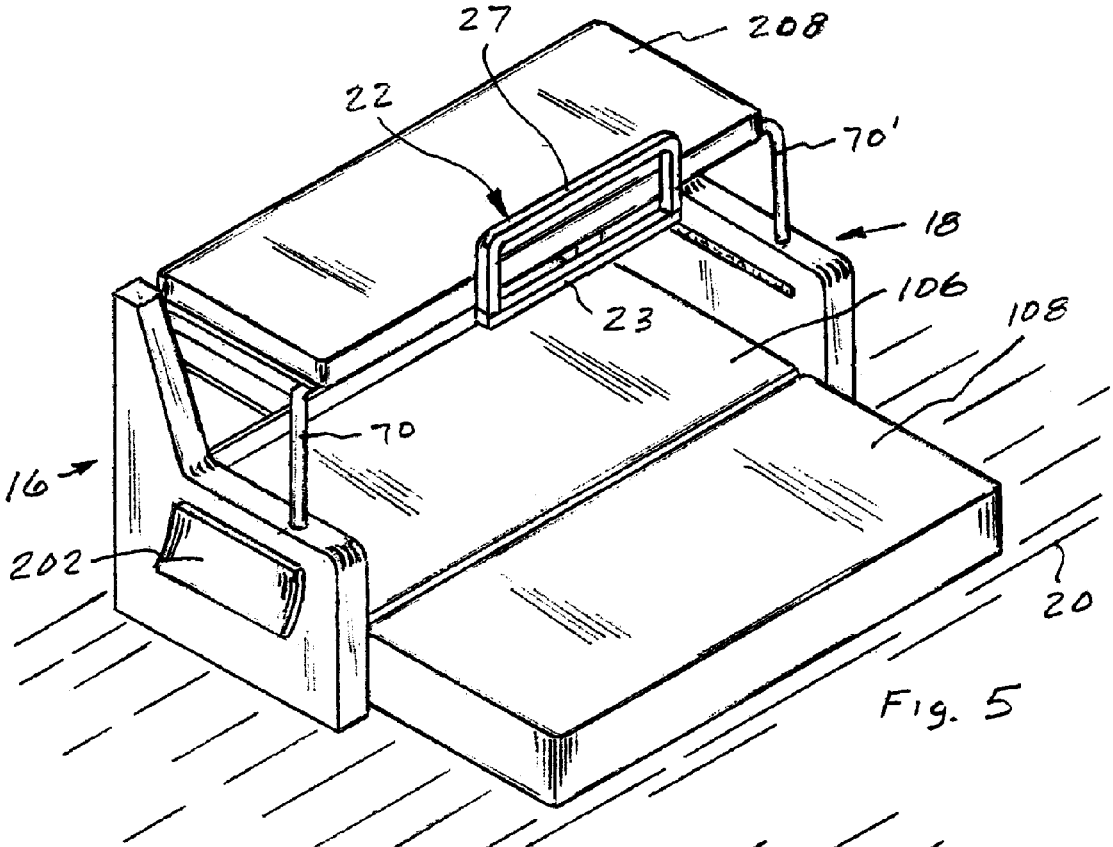
FIG. 5 is a schematic illustration of the sofa of FIG. 4 wherein a back is converted into a second sleeping surface.
Figure 6:
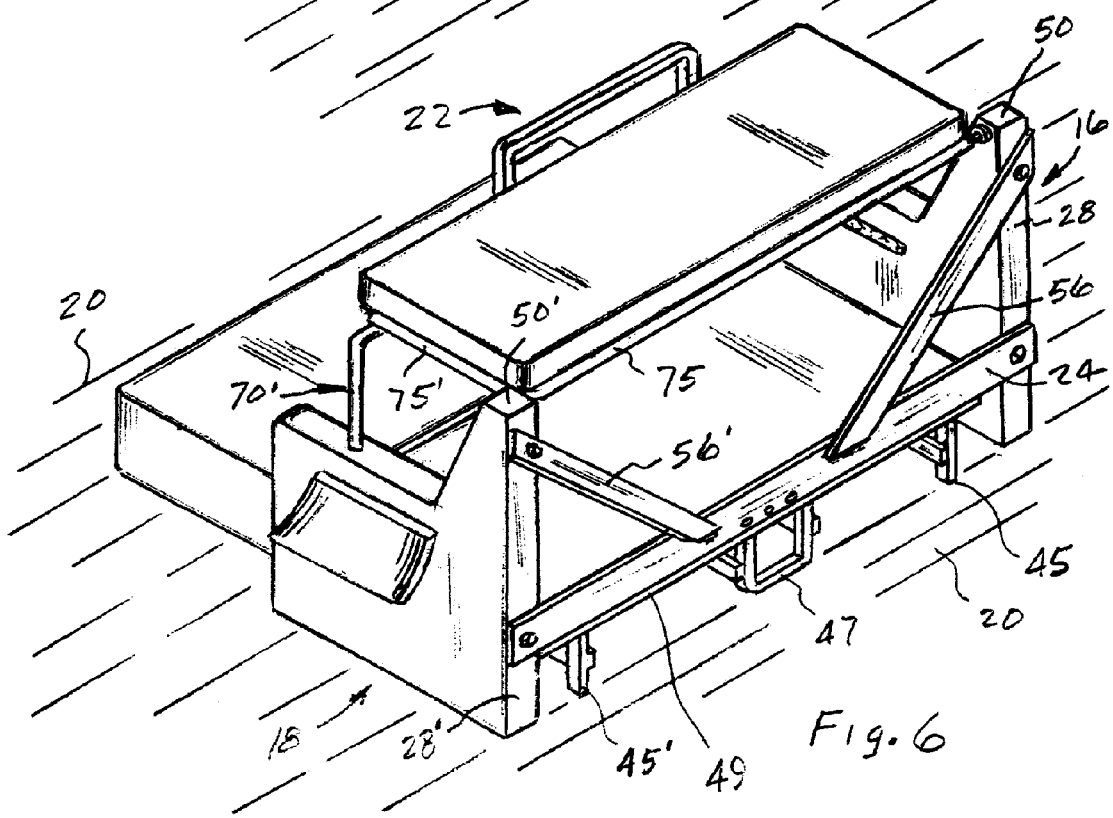
FIG. 6 is a schematic illustration of the rear of FIG. 5.

Should an additional sleeping surface be desired for another individual, the back 14 may be rotated from an inclined position illustrated in FIG. 4 to a horizontal position that is parallel with the first sleeping surface 108 illustrated in FIGS. 5 and 6 to define the second sleeping surface 208. The back 14 is maintained in the horizontal position by legs 70, 70' through the engagement with the first 16 and second 18 side members. In order to prevent an individual from rolling off the second sleeping surface 208 with the back 14 retained in the horizontal position, the side rail 22 is rotated 180° with respect to the back 14 to form a barrier and define an edge for the second sleeping surface 208.

The structural components that make up the sofa 10 are better illustrated in FIGS. 7-17 and are hereinafter specifically described.

Figure 8:
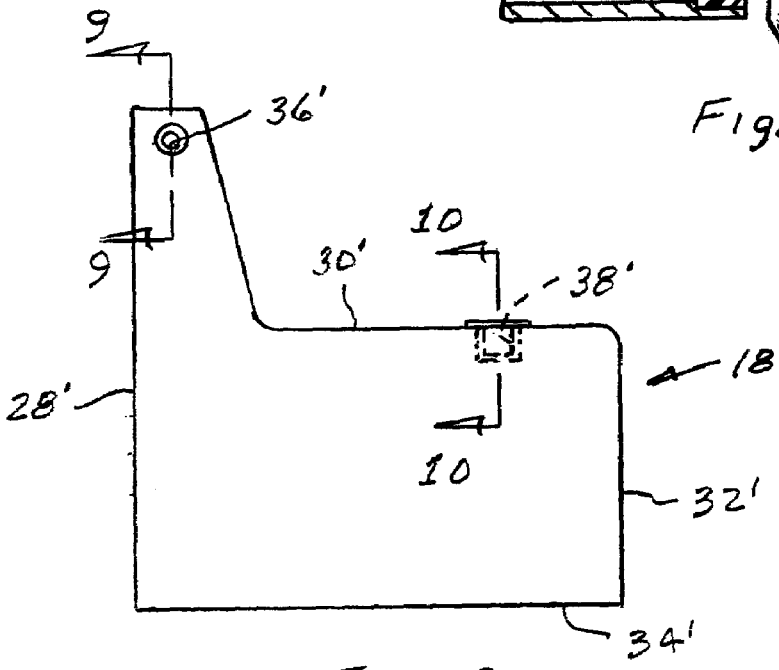
FIG. 8 is a view of a side member of the sofa of FIG. 1.
Figure 9:
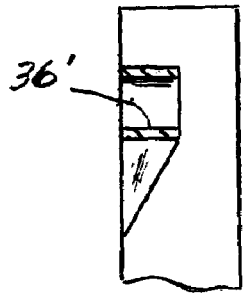
FIG. 9 is a view along line 9-9 of FIG. 8.
Figure 10:
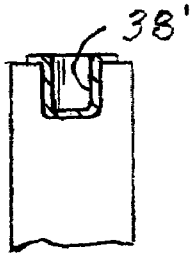
FIG. 10 is a view along line 10-10 of FIG. 8.

The first side member 16 and the second side member 18 are mirror images of each other and the specific description hereinafter applies to each. Each side member has a top 50 and a bottom 34, with the top 50 extending from a rear 28 face and transitioning into a ledge 30 that extends from a front face 32. Each side member has a horizontal bore 36 that is located adjacent the top 50 and the rear face 28 as illustrated in FIG. 9 and vertical bore 38, see FIG. 10, located in the ledge 30 at a fixed distance from the front face 32 as illustrated in FIG. 8.

Figure 7:
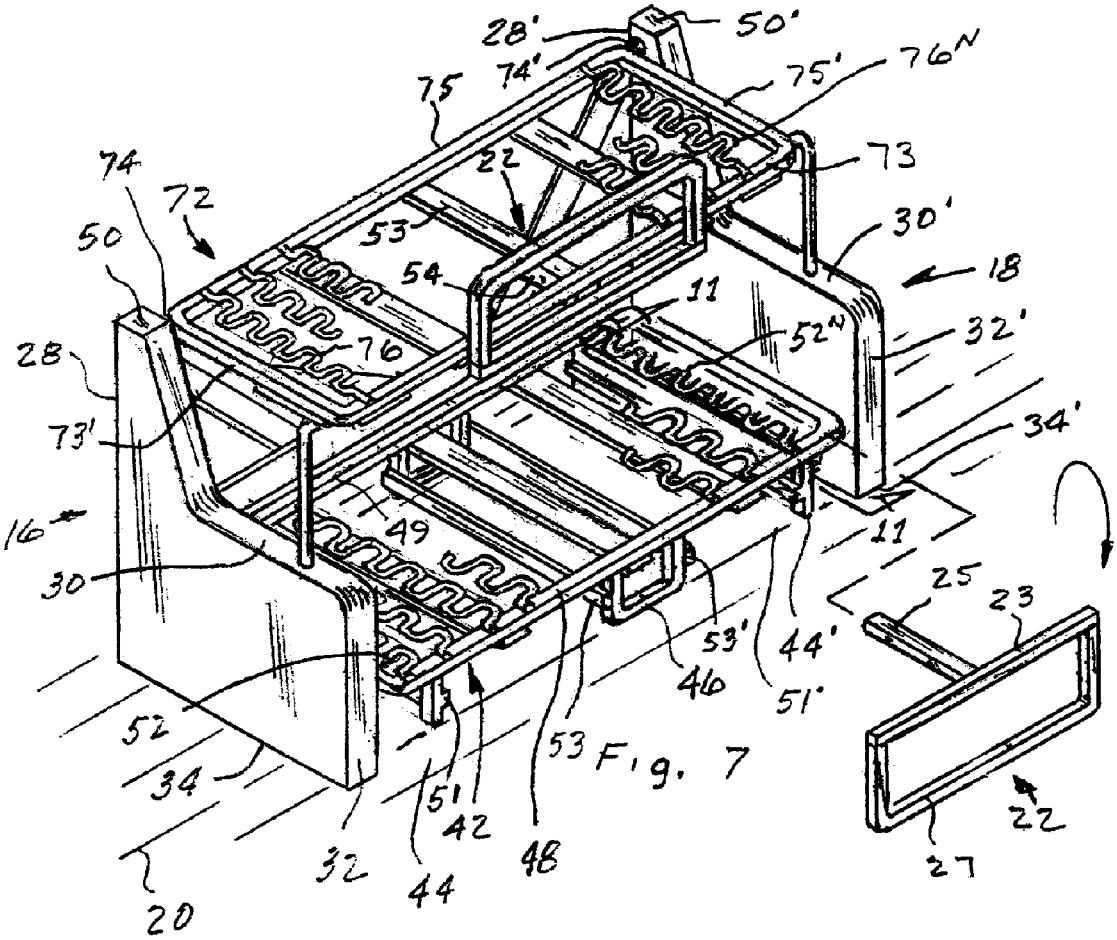
FIG. 7 is a schematic illustration of the inner structural components of the sofa of FIG. 1.
Figure 11:
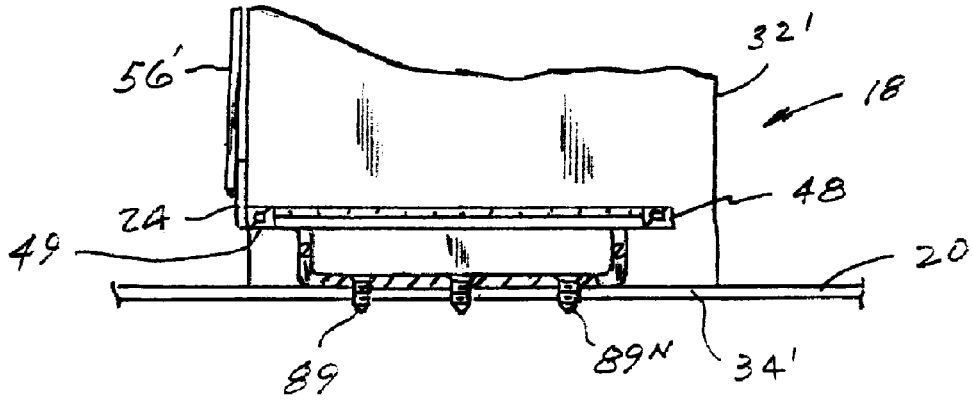
FIG. 11 is a view taken along line 11-11 of FIG. 7.
Figure 14:
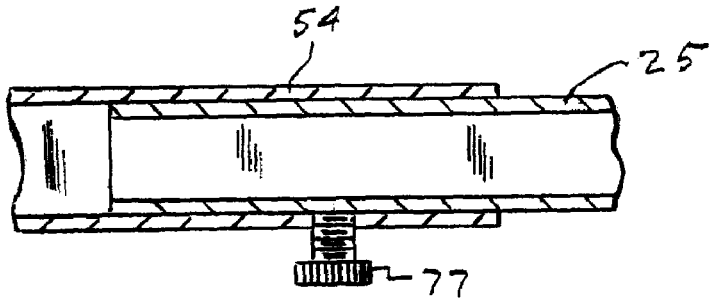
FIG. 14 is a sectional view taken along line 14-14 of FIG. 12.
Figure 13:
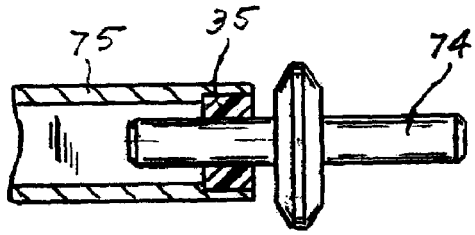
FIG. 13 is a view taken along line 13-13 of FIG. 12 illustrating the relationship between a pin retained in a side wall and the frame for the back of the sofa.

The seat 12 includes a first rectangular frame 42 that is fixed in a location adjacent the bottom 34 of the first side member 16 and adjacent the bottom 34' of the second side member 18, see FIGS. 7 and 11. The first rectangular frame 42 has end legs 44, 44' and center legs 46 that are located a front rail 48 and corresponding end legs 45, 45' and center legs 47 that are located on a real rail 49. The legs in addition to providing support for the rectangular frame 42 has guides 51,51' and 53,53' attached thereto that receive drawers 39,39' that are located under seat 12, as illustrated in FIGS. 6 and 7. A plurality of spring members 52, 52' - - - 52" extend between the front rail 48 and rear rail 49 of the first rectangular frame 42 to define a resilient support for the seat 12.

A beam 24, see FIG. 6, is fixed to rear face 28 on the side member 16 and rear face 28' on side member 18 and to rail 49 of the first rectangular frame 42 to define a solid base for the sofa 10. In order to maintain the side members 16 and 18 in a perpendicular relationship with the first rectangular frame 42, a first brace 56 that is fixed to the rear face 28 of the first side member 16 adjacent the top 50' and to the beam 24 and a second brace 56' fixed to rear face 28' of the second side member 18 adjacent top 50' and to beam 54. The angle of the first brace 56 and second brace 56' is such that the top 50 of the first side member 16 and top 50' of the second side member 18 are maintained in a substantially fixed position without flexing when subjected to a load placed thereon through the back 14.

The first rectangular frame 42 has a first mattress 100 attached thereto in the following manner, a first section 106 is fixed to the first rectangular frame 42 such that a hinge 104 is located along the front rail 48 to which a second section 102 is attached. The first section 106 has a thickness that is about one third the thickness of the second section 102 and with the second section 102 located over the first section 106, see FIG. 2, forms seat 12 for the sofa 10. The second section 102 is designed to be rotated about hinge 104 into a position along side of the first section 106 to define a horizontal and uniform sleeping surface 108 when the second section 102 rests on the floor 20 as illustrated in FIGS. 4 and 5.

Figure 12:
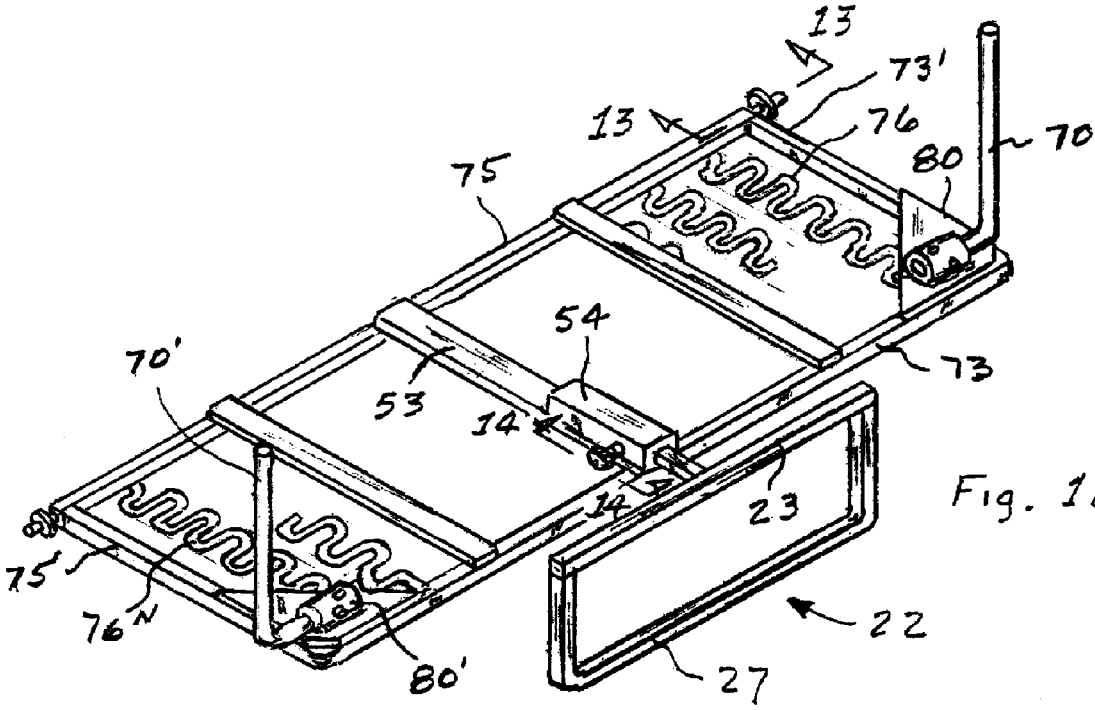
FIG. 12 is a view of the under side of the inner structure of the back of the sofa of FIG. 7.

The back 14 of sofa 10 includes a second rectangular frame 72 with a front rail 73 and a rear rail 75, see FIGS. 7 and 12. The second rectangular frame 72 has a first pin 74 that extends from a rear rail 75 and is positioned in horizontal bore 36 in the first side member 16 and a second pin 74' that extends from the rear rail 75 and is positioned in the horizontal bore 36' in the second side member 18 to secure the second rectangular frame 72 to the first 16 and second 18 side members. The pins 74, 74' are retained in grommets or bearings 35, 35' respectively located in the horizontal bores 36, 36' and allow the second rectangular frame 72 to rotate with respect to the first 16 and second 18 side members. A plurality of spring members 76,76' - - - 76" extend between the front rail 73 and rear rail 75 of the second rectangular frame 72 to define a resilient support for the back 14. A strap 53 is attached at a mid-point of the front rail 73 and extends to and is attached to a corresponding mid-point on the rear rail 75 to assist in preventing the second rectangular frame 72 from flexing. Strap 53 has a square tube 54 attached thereto that is positioned adjacent the front rail 73 to provide a guide for the side rail 22 that is defined by a third rectangular member.

The side rail 22 that is defined by a third rectangular member includes a base 23 from which a projection 25 extends and a top 27 that is parallel to and located at a fixed distance from the base 23. The fixed distance between the base 23 and the top 27 functions to set the incline for the back 14 with respect to the seat 12 and to define the height for a barrier above the second rectangular frame 72. The projection 25 which is square is received inside of the square tube 54 fixed to the second rectangular member 72, see FIGS. 2, 7 and 14 and on being inserted into tube 54 is held by a fastener or screw 77 such that the base 23 is located against front rail 73.

The first leg 70 and second leg 70' are identical to each other and the following description equally applies to each leg. The first 70 and second 70' legs are respectively attached to rectangular frame 72 through cylindrical members 80, 80' that are fixed at the corner of the front rail 73 and end rails 73', 75' as best illustrated in FIGS. 12, 15, 16 and 17. Each cylindrical member 80 has an axial bore 82, see FIG. 16, with a first 84 and second 86 radial bores that extends there from. The first radial bore 84 is separated from the second radial bore 86 by a fixed distance corresponding to a distance equal to the distance between a plane through the center of the vertical bore 38 in a side member and a plane through the center of the end rail 73' and the radial bore 84 is perpendicular to radial bore 86.

Figure 17:
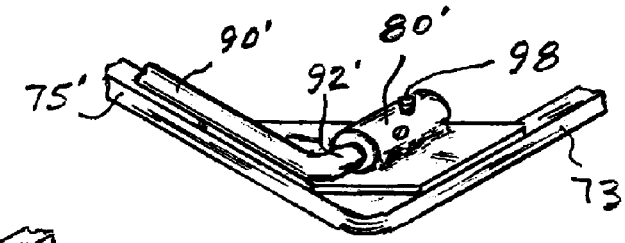
FIG. 17 is a schematic illustration of the leg of FIG. 15 in a retracted position.
Figure 15:
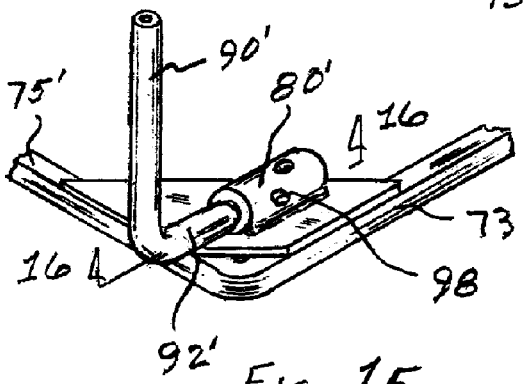
FIG. 15 is a schematic illustration of a leg associated with the inner structural for the back of the sofa in an perpendicular position.
Figure 16:
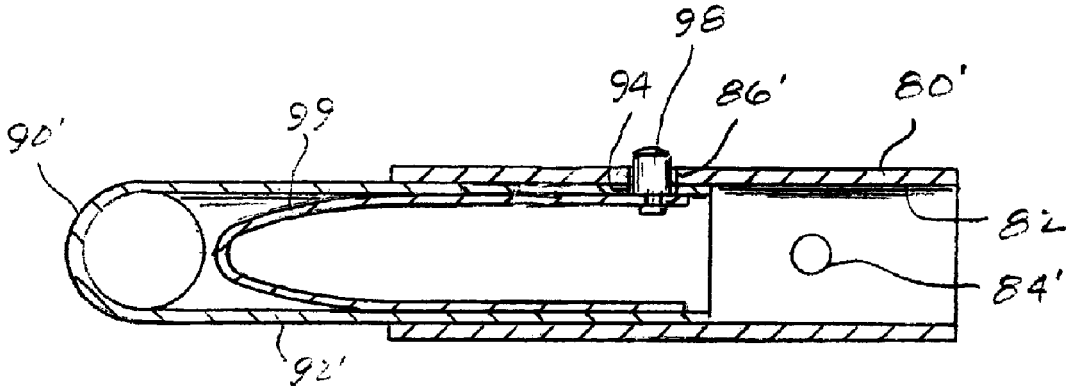
FIG. 16 is a sectional view of a locking arrangement taken along line 16-16 of FIG. 15.

Each leg 70, 70' includes a first section 90 and a second section 92 with the section 92 being perpendicular to the first section 90 and at least the second section 92 being formed from a cylindrical tube. The second section 92 has a radial bore 94 located adjacent the end 96 thereof that receives a button 98 to locate a keeper or spring clip member 99 within the second section 92 with the second section 92 being located in axial bore 82 of a cylindrical member 80, see FIG. 16 that is welded to brace 81 fixed at the intersection of the front rail 73 and side rails 73', 75'. With the first section 90 of leg 70 in the vertical position as shown in FIG. 12, button 98 extends through radial bore 94 in the second section 92 and radial bore 86 in cylindrical member 80 and when the first section of leg 70 is located in the horizontal position, as shown in FIG. 17 button 98 extends through radial bore 84 when the second section 92 is moved into axial bore 82 and the first section is rotated into parallel alignment with end member 73' of the second rectangular frame 72.

As illustrated in FIGS. 2, 5 and 6, a second mattress 200 is fixed to the second rectangular frame 72. The second mattress 200 is made of a resilient material and when stretched around the second rectangular frame 72 defines a resilient structure for back 12 to complete the structural assembly of the sofa 10.

On installation of the sofa 10 in a structure, screws 11 extend through a plate that extends from the end members of rectangular frame 42 to hold the sofa 10 in a fixed position with respect to the floor 20.

MODE OF OPERATION

Most states prohibit passengers from riding in a trailer when traveling on the highway and as a result the sofa 10 has the appearance as illustrated in FIG. 1. When parked, the sofa 10 may be used as a piece of furniture on which a person may sit on the seat 12 and rest his back against the back 15. The back 15 has an incline that is designed to provide support and comfort for the back of a person. When it is desired to convert the sofa 10 into sleeping surfaces, the second section 102 of seat 15 is rotated about hinge 104 and brought into engagement with floor 20 as illustrated in FIG. 4 to define a first horizontal sleeping surface 108. The size of the sleeping surface 108 is such that a first person may sleep on the first section 106 and a second person may sleep on the second section 102 without lying on the hinge 104.

Should additional sleeping quarters be desired, arm covers or shams 202,204 are respectively removed from the first side member 16 and second side member 18 to uncover cups in vertical bores 38, 38', see FIGS. 5, 7 and 8 and back 14 rotated about pins 74, 74' to bring the second rectangular frame 72 into a horizontal plane that is parallel with the first sleeping surface 108. The second rectangular frame 72 is held in the horizontal position by applying a force to button 98 on keeper or spring clip 99 and pulling leg 70 out of bore 86 while rotating leg 70 into the vertical position and leg 70' out of bore 86' while rotating leg 70' into a vertical position. The end of legs are located in the cups in the vertical bores 38,38' to maintain the second rectangular frame 72 in the horizontal position. Screw 77 is loosened and projection 25 pulled out of tube 54 and rotated 180° to bring top 27 above the top of the second sleeping surface 208 as illustrated in FIGS. 5 and 6.

When it is desired to return the sleeping surfaces 108 and 208 back into a sofa 10, the first step resides in reversing the side rail 22 such that top 27 is now located below the second rectangular frame 72, as illustrated in FIG. 2. Screw 77 is loosened and projection 25 pulled out of tube 54 and thereafter re-inserted in the tube 54 with base 23 tight against rail 73. The legs 70,70' are retracted by depressing buttons 98,98' and sliding the second section 92 into axial bore 86 while rotating the legs 70,70' from the vertical position to a horizontal position adjacent ends 73',75'. When buttons 98,98' are aligned with radial bores 84,84' spring clips 99,99' expand the buttons 98,98' into radial bores 84,84' to lock the legs 70,70' in the retracted position adjacent the end rails 73',75' of the second rectangular frame 72. The second rectangular frame 72 is lowered and the top 27 brought into engagement with beam 24 to define the incline for the resulting back 15 of the sofa 10, the top 27 is resiliently held against the beam 24 by the internal resiliency of the material of the first section 106 of the mattress. The second section of the mattress 102 is now rotated from its position on the floor as illustrated in FIG. 4 about hinge 104 to the position illustrated in FIG. 2 over the first section 102 to define the seat 12 for the sofa 10. Arm covers 202,204 are returned to cover the ledge surface 30, 30' of the first 16 and second 18 end members to complete the return of the components for the sofa 10 illustrated in FIG. 1.

What is claimed is:

1. A sofa that may be converted into multi-sleeping surfaces comprising:

a first side member having a first top that extends from a first rear face and transitions into a first ledge that extends from a first front face and a first bottom, said first side member having a first horizontal bore that is located adjacent the first top and first rear face and a first vertical bore that is located in the first ledge a fixed distance from the first front face;

a second side member having a second top that extends from a second rear face and transitions into a second ledge that extends from a second front face and a second bottom, said second side member having a second horizontal bore that is located adjacent the second top and second rear face and a second vertical bore located in the second ledge a fixed distance from the second front face;

a first rectangular frame that is fixed in a first location adjacent to the first bottom of said first side member and the second bottom of said second side member;

a beam that is fixed to said first rear face of the first side member, said second rear face of the second side member and to said first rectangular frame;

a first brace that is fixed to said first rear face of the first side member adjacent the first top and to said beam;

a second brace fixed to said second rear face of the second side member adjacent the second top and to said beam;

a first mattress having a first section that is secured to said first rectangular frame and a second section fixed said first section through a hinge, said second section being located over the first section to define the seat for said sofa and being rotatable about the hinge to a position along side of the first section to define a first sleeping surface;

a second rectangular frame having a first pin that extends there from and is positioned in the first horizontal bore in the first side member and a second pin that extends there from and is positioned in the second horizontal bore in the second side member to secure the second rectangular frame to the first and second side members, said second rectangular frame having a tube that extends from a front face to a rear face;

a third side member with a projection that extends into said tube in the second rectangular frame;

a fastener that is connected to the projection for retaining said third side member adjacent said front face of said second rectangular frame;

a first leg that is secured to said second rectangular frame by a first keeper member, said first leg being rotatable from a first position parallel with said second rectangular frame to a second position perpendicular to said second rectangular frame;

a second leg that is secured to said second rectangular frame by a second keeper member, said second leg being rotatable from a first position parallel with said second rectangular frame to a second position perpendicular to said second rectangular frame; and a second mattress that is fixed to said second rectangular frame, said second rectangular frame having a first position defined by the engagement of said third side member with said beam such that said second mattress is held in an inclined position to define said back for the sofa and a second position whereby said first leg is rotated into the second position and a first end thereof located in said first vertical bore in the first side member and the second leg is rotated into the second position a first end thereof located in said second vertical bore located in said second side member such that the second rectangular frame in a horizontal position with respect to the first rectangular frame and defines a second sleeping surface, said third side member being rotated within said tube in the second rectangular frame to a second position to thereafter provide a barrier adjacent the second sleeping surface.

2. The sofa as recited in claim 1 wherein said third side member is defined by a third rectangular frame having a base from which said projection extends and a top that is parallel to and located a fixed distance from the base, said inclined position of the back and the height of the barrier being a function of the fixed distance between the top and the base.

3. The sofa as recited in claim 2 wherein said fastener includes a screw that extends through the tube in the second rectangular member and into the projection.

4. The sofa as recited in claim 3 further including a first cylindrical member that is fixed to said second rectangular member, said first cylindrical member having a first axial bore therein, a first radial bore that extends from the first axial bore, a second radial bore that extends from the first axial bore, said first radial bore being separated from the second redial bore by a fixed distance and being perpendicular to each other with the first radial bore being vertical to and the second radial bore being horizontal to said second rectangular member, said first leg being connected to said second rectangular member through said first cylindrical member.

5. The sofa as recited in claim 4 further including a second cylindrical member fixed to said second rectangular member, said second cylindrical member having a second axial bore therein, a first radial bore that extends from the second axial bore, a second radial bore that extends from the second axial bore, said first radial bore being separated from the second axial bore by a fixed distance and being perpendicular to each other with the first radial bore being vertical to and the second radial bore being horizontal to said second rectangular member, said second leg being connected to said second rectangular member through said second cylindrical member.

6. The sofa as recited in claim 5 wherein said first keeper member is defined by a first resilient clip located within said a first portion of said first leg and having a first button that extends through the first leg, said first portion being located in said first axial bore of said first cylindrical member with the first button being selectively located in said first and second radial bores to hold the first leg in the first and second positions.

7. The sofa as recited in claim 6 wherein said second keeper member is defined by a second resilient clip located within said a first portion of said second leg and having a second button that extends through the second leg, said first portion being located in said second axial bore of said second cylindrical member with the second button being selectively located in said first and second radial bores to hold the second leg in the first and second positions.

8. The sofa as recited in claim 1 wherein said first section of said first mattress has a first area that covers the first rectangular frame and has a first thickness, said first thickness being sufficient to engage and assist in holding said third side member against the beam when the second rectangular frame is located in the first position.

9. The sofa as recited in claim 8 wherein said second section of said first mattress has a second area and a second thickness, said second thickness being about three times the thickness of said first section such that on being rotated on the hinge the second section engages a flat surface and located to define a uniform horizontal first sleeping surface.

10. The sofa as recited in claim 9 wherein said first rectangular frame further includes a plurality of rails, said plurality of rails defining guides for storage containers that are located under the first rectangular frame.

11. The sofa as recited in claim 10 wherein said first rectangular frame further includes a plurality of legs that engage the flat surface to assist in maintaining the first sleeping surface in the horizontal plane.

* * * * *